US010184276B2

(12) United States Patent
Sassone

(10) Patent No.: US 10,184,276 B2
(45) Date of Patent: Jan. 22, 2019

(54) DOORSTOP LIFTING DEVICE AND METHOD

(71) Applicant: Francis Gerard Sassone, New Orleans, LA (US)

(72) Inventor: Francis Gerard Sassone, New Orleans, LA (US)

( * ) Notice: Subject to any disclaimer, the term of this patent is extended or adjusted under 35 U.S.C. 154(b) by 461 days.

(21) Appl. No.: 14/615,306

(22) Filed: Feb. 5, 2015

(65) Prior Publication Data

US 2016/0230434 A1 Aug. 11, 2016

(51) Int. Cl.
*E05C 17/44* (2006.01)

(52) U.S. Cl.
CPC ..... *E05C 17/443* (2013.01); *E05C 17/44* (2013.01); *Y10S 292/15* (2013.01); *Y10T 292/1071* (2015.04); *Y10T 292/1072* (2015.04); *Y10T 292/1083* (2015.04); *Y10T 292/1085* (2015.04); *Y10T 292/65* (2015.04); *Y10T 292/71* (2015.04)

(58) Field of Classification Search
CPC ..... E05C 17/44; E05C 17/443; E05C 17/446; E05C 17/54; Y10T 292/65; Y10T 292/71; Y10T 292/1071; Y10T 292/1072; Y10T 292/1083; Y10T 292/1085; Y10S 292/15
USPC ..... 292/338, 342, DIG. 15, 237, 238, 202, 292/204; 248/351
See application file for complete search history.

(56) References Cited

U.S. PATENT DOCUMENTS 449,618 A * 3/1891 Drees ..... E05B 85/22 292/167
476,910 A * 6/1892 Wells ..... E05B 63/0017 292/139
490,504 A * 1/1893 Sartell ..... E05B 85/24 292/195
510,715 A * 12/1893 Shepard ..... E05B 85/22 292/153
561,373 A * 6/1896 Campbell ..... E05B 65/0007 292/153
638,139 A * 11/1899 Postle ..... E05B 65/0864 292/58
867,811 A * 10/1907 Edgcomb ..... E05C 19/06 292/338
1,185,547 A * 5/1916 Rugar ..... E05C 17/443 292/210
1,238,042 A * 8/1917 Moore ..... E05B 63/0017 292/139
1,375,388 A * 4/1921 Haralson ..... E05C 17/446 292/167
1,448,298 A * 3/1923 Hight ..... E05C 1/14 16/83
1,518,613 A * 12/1924 Teeter ..... E05F 11/00 292/169

(Continued)

FOREIGN PATENT DOCUMENTS

CH 110899 A * 7/1925 ..... E05C 17/446
FR 2780087 A1 * 12/1999 ..... E05C 17/446

(Continued)

*Primary Examiner* — Christine M Mills
(74) *Attorney, Agent, or Firm* — Garvey, Smith & Nehrbass, Patent Attorneys, L.L.C.; Julia M. FitzPatrick; Charles C. Garvey, Jr.

(57) ABSTRACT

The Lift Stop device includes an aluminum rod that is attached to a doorstop that is secured to a door for the purpose of lifting a doorstop from its down position to an up position.

15 Claims, 4 Drawing Sheets

(56) References Cited

U.S. PATENT DOCUMENTS

| | | | | | |
|---|---|---|---|---|---|
| 1,590,394 | A * | 6/1926 | Rawlings | E05C 17/446 | 292/182 |
| 1,661,240 | A * | 3/1928 | Trimbach | E05C 17/443 | 292/338 |
| 4,494,784 | A * | 1/1985 | Haynes | E05C 17/443 | 16/82 |
| 4,514,000 | A * | 4/1985 | Chezem | E05C 17/443 | 292/338 |
| 4,666,195 | A * | 5/1987 | Thomas, III | E05C 17/443 | 292/336.3 |
| 4,673,203 | A * | 6/1987 | Chezem | E05C 17/443 | 292/338 |
| 4,759,577 | A * | 7/1988 | Thomas, III | E05C 17/443 | 292/338 |
| 5,098,138 | A * | 3/1992 | Vandewege | E05C 17/443 | 292/338 |
| 5,601,319 | A * | 2/1997 | Morin | E05C 17/443 | 292/139 |
| 2013/0318882 | A1* | 12/2013 | Booker | E05C 17/54 | 49/506 |

FOREIGN PATENT DOCUMENTS

| | | | | |
|---|---|---|---|---|
| GB | 191010061 | A * | 12/1910 | E05C 17/446 |
| GB | 199922 | A * | 7/1923 | E05C 17/446 |
| KR | 101204323 | B1 * | 11/2012 | E05C 17/443 |

* cited by examiner

DOORSTOP LIFTING DEVICE AND METHOD

Be it known that I Francis Sassone, a citizen of the United States, residing in New Orleans, La., have invented a certain new and useful device to lift a doorstop from a down position to an up position; and I declare the following to be a full, clear, and exact description of the invention, such as will enable others skilled in the art to which it appertains to make and use the same, reference being had to the accompanying documentation which form a part of this specification.

This invention relates to a certain new device useful in lifting doorstops and I aim to provide a device which its specific function is designed to lift a door stop from a down position to an up position by means of an aluminum rod 2, fastened to a door, that is attached to a doorstop 5, via a yoke 8, that actuates the lifting of a doorstop when the aluminum rod 2, is pulled upward.

An aluminum rod 2, is attached vertically to a door with two brackets 3, through which an aluminum rod 2, is inserted, allowing an aluminum rod 2, to vertically slide up and down.

LIFT STOP III is made with an aluminum rod, approximately 1.25 centimeters in diameter. The rod will be attached to a door with three brackets with small hoops, allowing the rod to slide up and down. The top of the rod will have an "L" shape in it, for pulling the rod upward. The rod will be attached to the doorstop by a via the metal "YOKE", through a hole drilled through the doorstop, that will pull the doorstop upward into its "up" position to allow the door to close.

A vertically attached aluminum rod 2, is pulled upward through two eye brackets 3, by placing a finger under an "L" shape bend 7, at the top of an aluminum rod 2, commencing to pull an aluminum rod 2 upward floor hence lifting a doorstop 5, into an upright position, allowing a door to close.

DETAILED DESCRIPTION

The LIFT STOP III was designed and manufactured to literally "lift" a doorstop from its down position to its up position without having to bend over to lift it by hand or to "kick" it back up with the toe of a shoe. There is no product or device like this on the market.

The design is a simple rod that is attached to any conventional wooden or metal door with a doorstop already attached to the door or as a complete unit attached to the doorstop. The LIFT STOP III will be sold as a complete unit, with specific, easy to follow instructions on how to install it. Included in the unit will be an aluminum rod that will come in gold or silver already attached at the manufacturer to the door stop, three eye hole mounting brackets to mount the rod to the door and a set of wood and metal screws for each bracket. Wood screws for a wooden door, metal screws for a metal door.

The method of installation is to screw the doorstop to the bottom of the door, then attach the brackets, holding the rod, evenly spaced onto the door.

The LIFT STOP III with the LIFT RING can be used on doors where the doorstop is already attached and in use.

The method of installation: slip the existing door stop through the LIFT RING, then attach the rod to door by using the attached brackets, holding the rod, onto the door.

Figure 1:
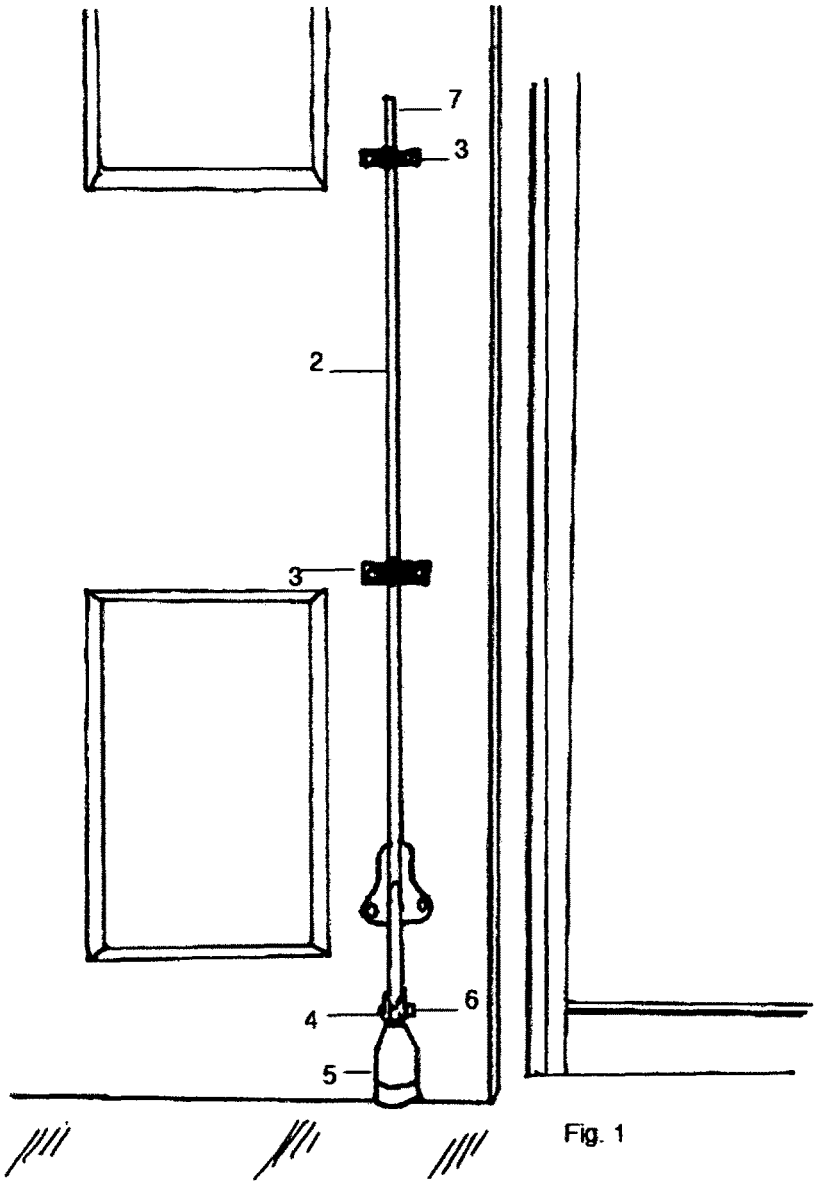
FIG. 1 is an overview of the device attached to a door.
Figure 2:
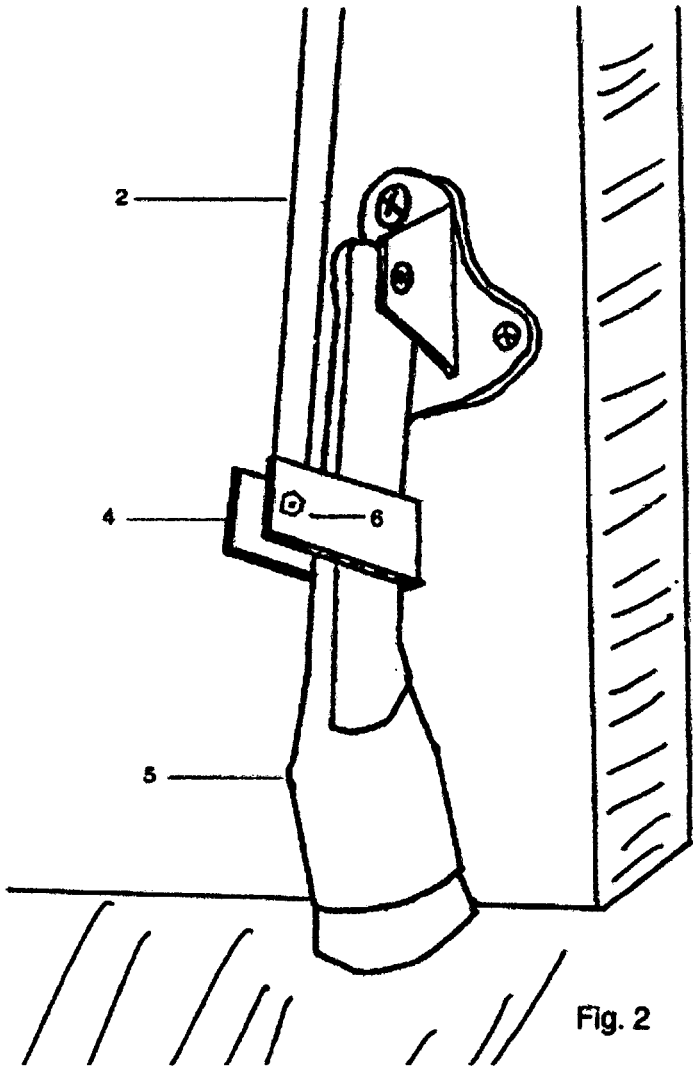
FIG. 2 is an enlargement of the device being used with an existing doorstop 5, showing a lift ring 4, attached to an aluminum rod 2, by a pin 6.
Figure 3:
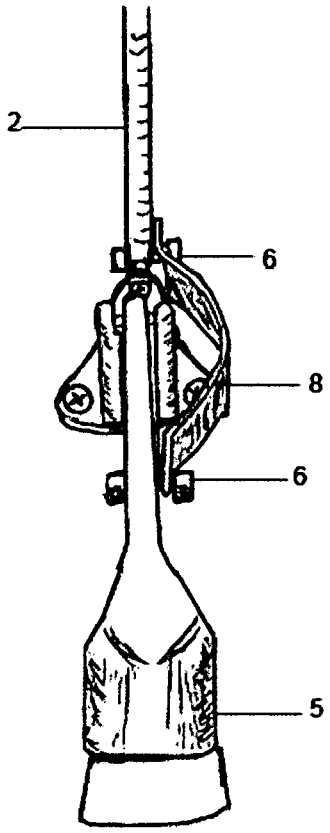
FIG. 3 shows the device with a doorstop 5, connected to a yoke 8, fastened by a pin 6, to an aluminum rod 2.
Figure 4:
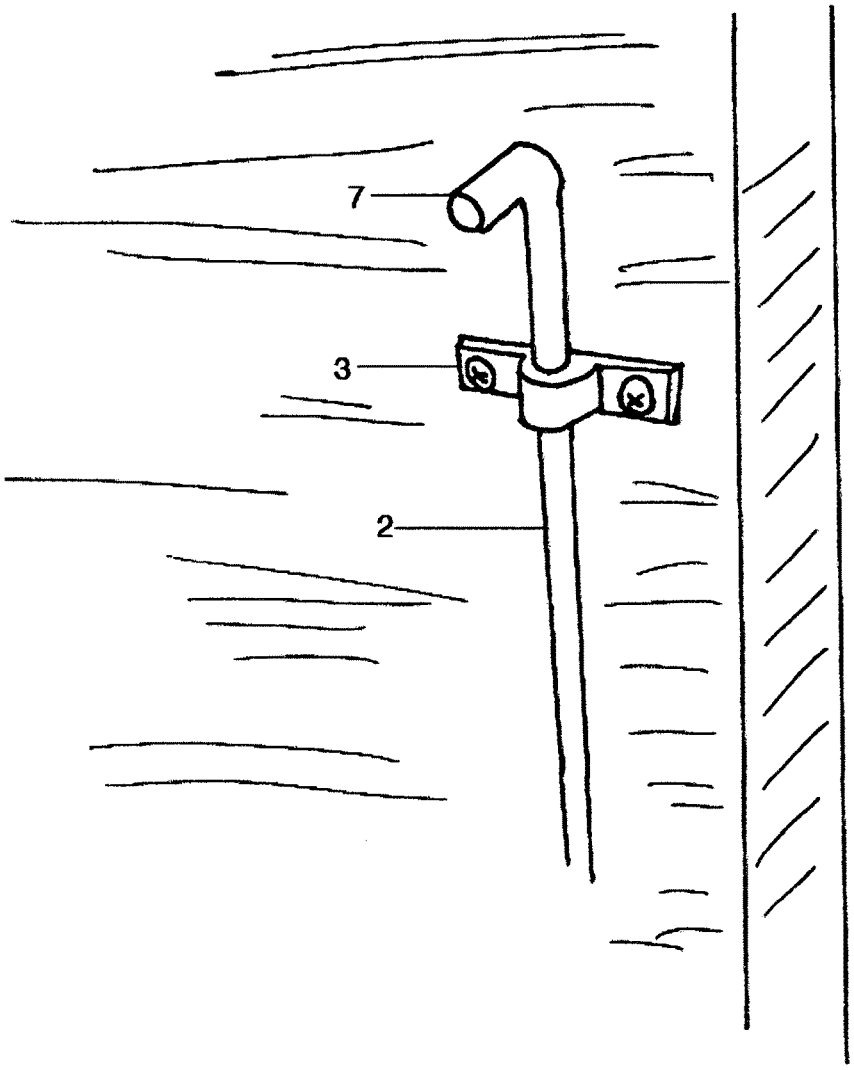
FIG. 4 is a partial, cut away view showing a top of a rod that can be used in one or more embodiments of a door stop lifting device of the present invention.

The device comprising of an aluminum rod 2, and a yoke 8, that when fastened to a doorstop 5, the lifting of a doorstop can be facilitated.

The invention claimed is:

1. A doorstop lifting device comprising:

a) a doorstop hingedly connected to a door at a doorstop hinged connection, the doorstop operable to move from a doorstop down position wherein the doorstop is engaging a ground surface to a doorstop up position wherein the doorstop is off the ground surface;

b) a rod extending upwards above the doorstop hinged connection, the rod slidably mounted to the door wherein the rod is slidably movable between a rod down position and a rod up position;

c) the rod having a top portion that is sized and shaped to accommodate a user's finger to pull the rod upward from the rod down position to the rod up position;

d) a hinged yoke that is movable about a pin, the hinged yoke connected to the rod above the doorstop hinged connection at a first yoke end and connected to the doorstop at a second yoke end below the doorstop hinged connection, the hinged yoke having an upper yoke portion, a middle yoke portion and a lower yoke portion, wherein the upper yoke portion includes the first yoke end and wherein the upper yoke portion extends laterally away from the doorstop hinged connection to the middle yoke portion, wherein the middle yoke portion extends downward from the upper yoke portion to the lower yoke portion which includes the second yoke end, and wherein the middle yoke portion is offset and spaced away from the first yoke end and the second yoke end; and e) the doorstop lifting device movable between a lowered position and a raised position, wherein in the lowered position the doorstop is in the doorstop down position engaging the ground surface and the rod is in the rod down position, and wherein in the raised position the doorstop is in the doorstop up position and the rod is in the rod up position and wherein pulling upward on the top portion of the rod causes the doorstop lifting device to move from the lowered position to the raised position allowing the door to close.

2. The doorstop lifting device of claim 1 wherein the rod is aluminum.

3. The doorstop lifting device of claim 1 wherein the rod is slidably mounted to the door within at least two brackets.

4. The doorstop lifting device of claim 1 wherein the rod is slidably mounted to the door within at least three brackets.

5. The doorstop lifting device of claim 1 wherein the first yoke end is attached to the rod with a pinned connection including the pin.

6. A doorstop lifting system for use with an existing doorstop that is hingedly connected to a door, the doorstop lifting system comprising:

a) the doorstop, which is hingedly connected to the door at a doorstop hinged connection, the doorstop operable to move from a doorstop down position wherein the doorstop is engaging a ground surface, to a doorstop up position wherein the doorstop is off the ground surface;

b) a lift member including an opening that is sized and shaped to accommodate the doorstop and a rod at a location below the doorstop hinged connection, wherein the doorstop and the rod can be slipped through the opening of the lift member, and wherein the lift member has two spaced apart plates with the opening in between the two spaced apart plates;

c) the doorstop and the rod, at the location below the doorstop hinged connection, positioned within the opening of the lift member;

d) wherein the rod is pivotally connected to the lift member at a lift member connection that is below the doorstop hinged connection and wherein the rod is also slidably connected to the door within a bracket connection, the rod extending upwards from the lift member connection and above the doorstop hinged connection, and wherein the rod is slidably movable between a rod down position and a rod up position;

e) the rod having a top having a size and shape to accommodate a user's finger to move the rod upward from the rod down position to the rod up position; and f) the doorstop lifting system movable between a lowered position and a raised position, wherein in the lowered position the doorstop is in the doorstop down position engaging the ground surface and the rod is in the rod down position, and wherein in the raised position the doorstop is in the doorstop up position and the rod is in the rod up position, and wherein movement of the rod upwards causes the doorstop lifting system to move from the lowered position to the raised position allowing the door to close.

7. The doorstop lifting system of claim 6 wherein the rod is aluminum.

8. The doorstop lifting system of claim 6 wherein the bracket connection comprises at least two brackets.

9. The doorstop lifting system of claim 6 wherein the bracket connection comprises at least three brackets.

10. The doorstop lifting system of claim 6 wherein the lift member connection is a pin connection.

11. A doorstop lifting system comprising:

a) a doorstop that is connected to a door at an upper doorstop hinged connection, the doorstop having a bottom surface and operable to move from a doorstop down position, wherein the doorstop bottom surface is engaging a ground surface, to a doorstop up position, wherein the doorstop is off the ground surface;

b) a doorstop connector having an opening that is sized and shaped to accommodate the doorstop and a rod at a location that is in between the upper doorstop hinged connection and the doorstop bottom surface, and wherein the doorstop connector includes two spaced apart plates and the opening is in between the two spaced apart plates;

c) wherein the doorstop connector extends in front of the doorstop and the door;

d) the doorstop and the rod, at the location in between the upper doorstop hinged connection and the doorstop bottom surface, positioned within the opening of the doorstop connector when in the doorstop down position;

e) the rod coupled to the doorstop connector in front of the doorstop and the door at a lower doorstop pivot connection, wherein the rod and the doorstop are in the opening of the doorstop connector, with the rod positioned in front of the doorstop and connected to the lower doorstop pivot connection when the doorstop is in the doorstop down position;

f) wherein the rod is also slidably coupled to the door within a bracket connection, wherein the rod is slidably movable between a rod down position and a rod up position, and wherein the rod extends upwards from the doorstop connector, the rod being spaced laterally away from the upper doorstop hinged connection and extending a first distance below the upper doorstop hinged connection and a second distance above the upper doorstop hinged connection when the rod is in the rod down position; and g) the doorstop lifting system movable between a lowered position and a raised position, wherein in the lowered position the doorstop is in the doorstop down position engaging the ground surface and the rod is in the rod down position, and wherein in the raised position the doorstop is in the doorstop up position and the rod is in the rod up position, and wherein movement of the rod upwards causes the doorstop lifting system to move from the lowered position to the raised position allowing the door to close.

12. The doorstop lifting system of claim 11 wherein the rod is aluminum.

13. The doorstop lifting system of claim 11 wherein the bracket connection comprises at least two brackets.

14. The doorstop lifting system of claim 11 wherein the bracket connection comprises at least three brackets.

15. The doorstop lifting system of claim 11 wherein the lower doorstop pivot connection is a pin connection.

* * * * *